United States Patent [19]

Lerner

[11] 3,986,911

[45] Oct. 19, 1976

[54] ETCHING OF SHADOW MASK ELECTRODES

[75] Inventor: Martin L. Lerner, River Forest, Ill.

[73] Assignee: Zenith Radio Corporation, Chicago, Ill.

[22] Filed: June 28, 1974

[21] Appl. No.: 484,358

Related U.S. Application Data

[63] Continuation of Ser. No. 45,681, June 12, 1970, abandoned.

[52] U.S. Cl. ..... 156/8; 156/11; 156/345

[51] Int. Cl.[2] ..... C23F 1/02

[58] Field of Search ..... 156/7, 8, 11, 16, 18, 156/345; 96/36, 36.1, 36.4, 38

[56] References Cited

UNITED STATES PATENTS

| | | | |
|---|---|---|---|
| 2,762,149 | 9/1956 | Mears | 156/8 |
| 2,822,635 | 2/1958 | Mears | 156/8 |
| 2,895,814 | 7/1959 | Clark | 156/7 |
| 2,961,314 | 11/1960 | Amdursky et al. | 96/38 |

*Primary Examiner*—William A. Powell
*Attorney, Agent, or Firm*—Cornelius J. O'Connor

[57] ABSTRACT

The shadow mask of a color cathode ray tube is supported upside down in an etching machine and the etchant is directed vertically upward from beneath the shadow mask. By upside down is meant that the apertured mask faces downward while the surrounding frame faces vertically upward.

3 Claims, 5 Drawing Figures

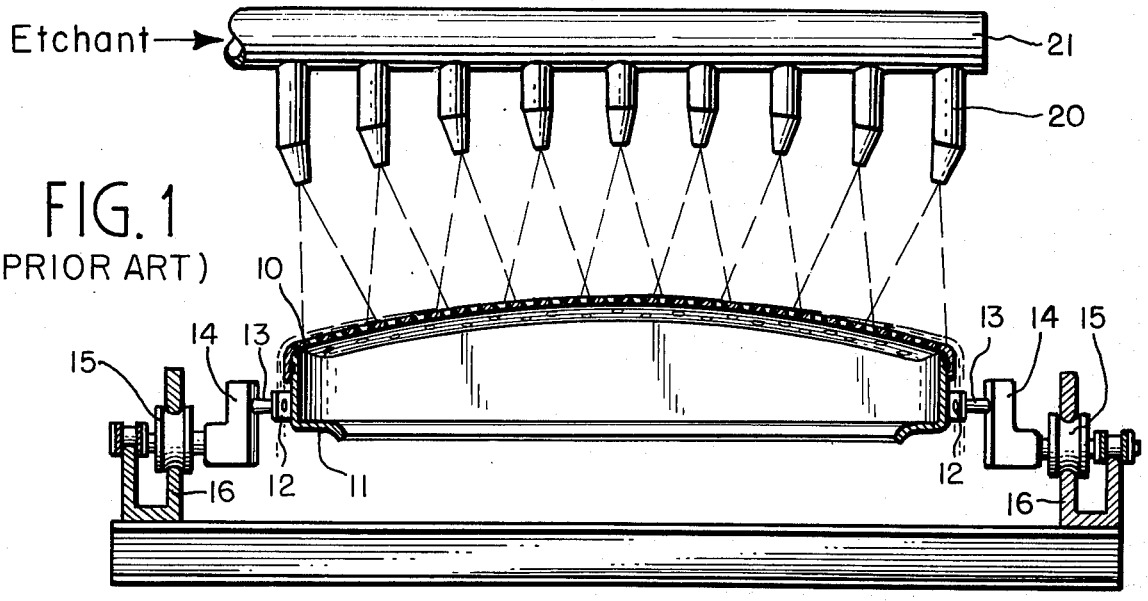
FIG. 1
(PRIOR ART)
FIG. 3
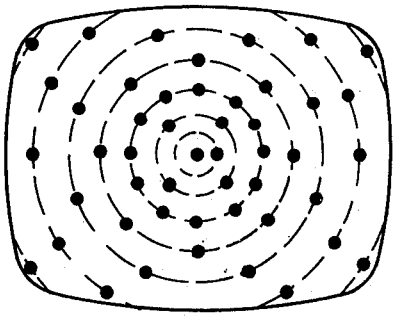
FIG. 1a
(PRIOR ART)
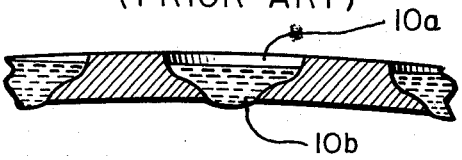
FIG. 2a
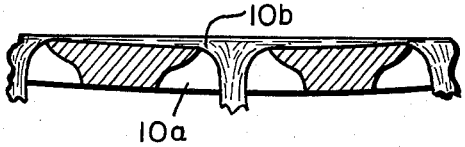
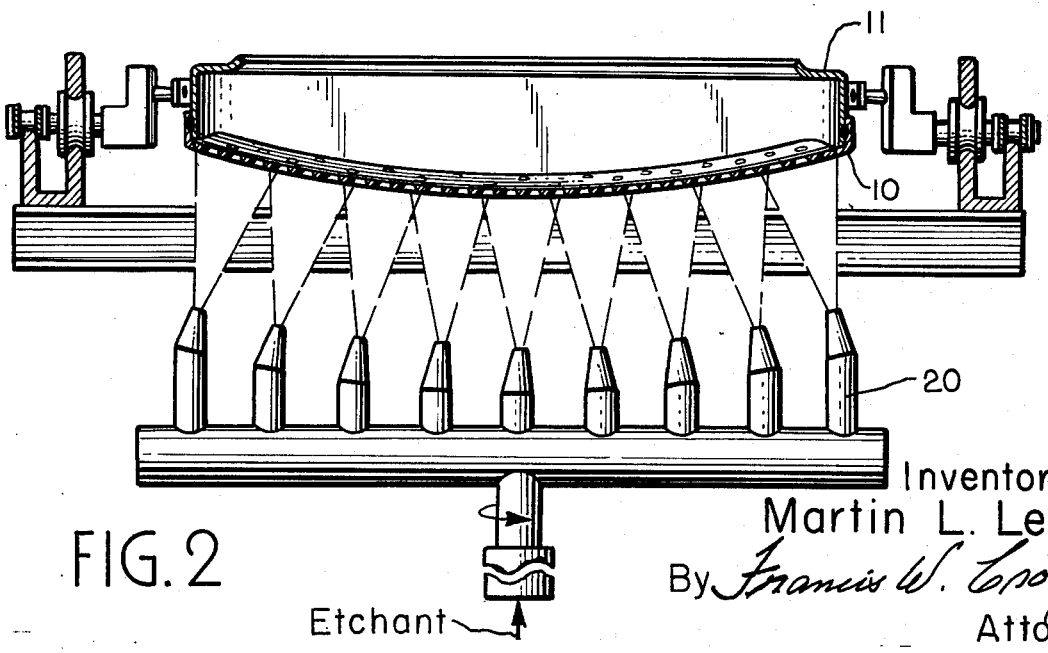
FIG. 2
Inventor
Martin L. Lerner
By Francis W. Crosby
Attorney

ETCHING OF SHADOW MASK ELECTRODES

This application is a continuation of my copending application Ser. No. 45,681, filed June 12, 1970, Etching of Shadow Mask Electrodes, assigned to the same assignee as the present invention now abandoned.

BACKGROUND OF THE INVENTION

The present invention concerns the processing of a color cathode ray tube and is directed most particularly to the etching of the color selection electrode of a color tube of the shadow mask variety. In greatest particularity, the invention is addressed to re-etching the shadow mask to enlarge its apertures to a desired predetermined size.

The need for re-etching the shadow mask in color tubes of the type under consideration presents itself when it is desired to have the phosphor deposits on the screen of the tube of smaller dimension than the apertures of the color selection electrode. This requirement is characteristic of both the so-called black surround shadow mask tube and the post-deflection-acceleration or post-deflection-focus color tube.

A preferred form of black surround tube is the subject of U.S. Pat. No. 3,146,368 issued on Aug. 25, 1964 1964 in the name of Joseph P. Fiore et al, and assigned to the assignee of the present invention. In its commercial form its screen is comprised of a multitude of phosphor dot triads each of which has a dot of green, a dot of blue and a dot of red phosphor. Instead of dimensioning the phosphor dots so that they are tangential with respect to one another, the dots are of reduced size so that there is a distinct separation between dots and a pigment or light absorbing material is deposited in those spaces, in effect surrounding each of the dots with a black material. By arranging the holes of the shadow mask to have a larger diameter than the phosphor dots, the electron beams are correspondingly larger than the phosphor dots and the full illumination of the dots permits maximum utilization of the phosphors while the black surround material contributes maximum contrast.

In the post-deflection-focus type of tube the electron beams are subject to a focus field on the screen side of the center of deflection which increases the extent to which electrons of the scanning beams are permitted to impinge on the screen. Because of the post-deflection-focus effect the beams are reduced in diameter and therefore it is desirable to have the phosphor dots smaller than the holes of the shadow mask.

In constructing the shadow mask tube with phosphor dots smaller than the apertures of the mask, it is convenient to form the shadow mask initially with a field of apertures that are sized appropriately for use in photoprinting of the screen. After the mask has been employed in screening, the holes are enlarged to the size, in relation to the size of the phosphor dots, that is desired in the completed tube. Enlargement of the holes may be accomplished by etching if the mask is made of metal such as steel which is normally the case. Since the holes are initially formed in the mask by etching, the enlarging step has come to be known as re-etching of the mask. In accordance with prior practice the re-etching process has been conducted by spraying an etchant over the mask with the intention of having the etchant pass through the holes to effect further etching and the desired enlargement of holes. Previously, the mask has been supported with its apertured portion vertically upward and its frame extending vertically downward but this introduces difficulties in the re-etch process when the spray is directed from above the mask. Such difficulties are avoided by the teachings of the subject invention.

SUMMARY OF THE INVENTION

In the manufacture of a color cathode ray tube having a color selection electrode comprising a mask that inludes a convex surface provided with a field of apertures, each of which apertures has large diameter and small diameter portions, which electrode further has a frame extending from the mask to define a circumscribing flange, the process of re-etching the electrode comprising the following steps:

1. supporting the electrode in an etchant station with the frame vertically disposed and with the convex surface of the mask facing downward and with the large diameter portions of the apertures also facing downward,

2. spraying an etchant solely from beneath the electrode vertically upward against the convex surface into the large diameter portions of the apertures and out through the smaller diameter portions of the apertures to increase the size of the apertures a predetermined amount and,

3. maintaining the electrode with the convex surface facing downward while the etchant that penetrated the apertures is permitted to flow back down through the apertures to contribute further to the enlargement of the apertures.

BRIEF DESCRIPTION OF THE DRAWING

The features of the present invention which are believed to be novel are set forth with particularity in the appended claims. The invention, together with further objects and advantages thereof, may best be understood by reference to the following description taken in connection with the accompanying drawing, in the several figures of which like reference numerals identify like elements, and in which:

FIGS. 1 and 1*a* depict a prior art shadow mask etching process;

FIGS. 2 and 2*a* are similar views illustrating the improved etching process of the subject invention; and FIG. 3 is a view utilized in explaining grading of the holes in the aperture mask.

DESCRIPTION OF THE PREFERRED EMBODIMENTS

Color television image reproducing devices operating on the parallax or shadow mask principle may have specifically different forms as well as sizes. For example, the screen may be round or rectangular and the phosphor deposits may take the shape of stripes or dots. The color selection electrode or shadow mask has electron transparent portions, usually in the forms of holes or openings, related in configuration to the configuration of the phosphor deposits. Where the phosphor is laid down in the form of stripes, for example, the shadow mask has elongated slots or openings while the shadow mask has a field of circular holes when associated with a mosaic screen having phosphor dots arranged to define phosphor triads. The specifics of the tube in these respects are of no concern to the present invention but, for convenience, it will be assumed that the color selection electrode in process is for a shadow mask tube of rectangular configuration having a screen comprised of phosphor dot triads.

The structure of such a tube and the techniques of screening are sufficiently well known that they need not be set forth herein. Suffice it to say that its color selection electrode has a mask of rectangular configuration dimensioned to correspond with the image or screen area of the tube of which it is to become a part. The mask has a rectangular field of apertures that are smaller than desired for the final form of the mask but are appropriate so that the mask may be employed in photoscreening of the face panel section of the tube. A frame circumscribes the mask and extends therefrom in substantially normal relation to define a flange. The mask has leaf-type mounting springs, three or four in number, which are welded to the frame at one end and have triangular shaped openings at the opposite end. These openings are dimensioned and the leaf springs are suitably configured to facilitate supporting the color selection electrode within the faceplate section of the tube by having the apertures of the leaf springs engage mounting studs which project inwardly of the flange of the faceplate of the tube.

If it be assumed that the mask has been utilized in screening and that the screening has been finished, the mask must be further processed or re-etched to enlarge its apertures to a desired final size. Advantages realized with the subject invention are most readily perceived by comparing the process of the invention with the prior practice of the art. As indicated in FIG. 1, it has been customary to support the color selection electrode or shadow mask in an etching station with its mask 10 vertically upward and its frame 11 extending vertically downward. The mask is easily supported in this position by having its mounting springs 12 engage studs 13 of a supporting fixture 14. The fixture is usually an open frame suitably dimensioned to accommodate the shadow mask in process and having rollers 15 to engage rails 16 to facilitate advancing the fixture with the mask it supports from one station to the next in a multistation etching machine. Machines of this type are well known in the art and are disclosed, for example, in U.S. Pat. Nos. 2,762,149 and 2,822,635. They may involve a washing stage, one or more etching stages and a final wash to remove the etchant from the mask. Only the etching stage is of concern to this description and it is adequately represented by FIG. 1. Above mask 10, which is positioned in the etching work station, is an array or cluster 20 of spray heads to which an etchant is delivered from a supply by means of a manifold 21. In the usual case the mask is formed of annealed steel and ferric chloride is the etchant. The spray heads deliver a cone of etchant on the top surface of mask 10 and the array of spray heads is designed to the end that the etchant is applied uniformly over the field of apertures of the mask. The intent is that the etchant will traverse the holes of the mask and its concentration, temperature and time of application are adjusted so that each of the holes is etched and thereby enlarged a preselected amount.

Experience makes clear that this theoretical re-etching and enlarging of the holes does not, in fact, take place. As indicated in the sketch of FIG. 1*a*, each hole of the mask is formed of a large diameter recessed portion 10*a* opening onto the convex surface of the mask and terminating in a smaller-diameter section 10*b* which opens onto the concave surface of the mask and determines the effective size of each of the apertures of the mask. With the shadow mask supported in the position illustrated, which typifies the past practice of the art, the large diameter portion 10*a* faces upward and serves as a well that fills in response to the etch spray directed from above it. The etchant tends to form a meniscus at the narrow opening 10*b* of each of the holes of the mask and, therefore, traps a pool of etchant above it. This occurs at each of the apertures of the mask and greatly impedes the flow of etchant through the holes. As a consequence, the etchant tends to flow from the center of the mask radially outward toward the edges since the mask is spherical or dome shaped. It is known that etching results from the movement of the etchant with respect to the metal and since the movement in the arrangement of FIG. 1 is largely radial from the center of the dome to frame 11, the predominant effect is a removal of the metallic portion of the mask that intervenes apertures 10*a*. In other words, the result is a material reduction in the thickness of the mask blank by the etching of its convex surface and not an etching confined to enlarging the apertures of the mask. This leads to a severe mechanical weakening of the mask so that it is undesirably subject to damage in fabricating the tube and, of course, if the mask is damaged the entire tube in process is wasted simply because the mask is uniquely paired with the screen of a given tube being manufactured.

In sharp contrast, the process of the subject invention features the step of supporting the shadow mask with its formed apertures inverted as indicated in FIG. 2*a*, that is to say, the small diameter portion 10*b* is uppermost and the large diameter portion 10*a* faces downward. This is arranged by supporting the mask in inverted fashion with its frame portion 11 vertically disposed and, for the usual construction, the frame extends vertically upward because the small-diameter portions 10*b* normally open into the surface of mask 10 that is contiguous to frame 11. The next significant change is in the application of the etchant which, in accordance with the invention, is directed solely from beneath the mask into contact with its holes. In other words, while the etchant is sprayed the array of spray heads 20 is positioned beneath the mask in process and the spray is directed vertically upward through the apertures of the mask.

Etchant that strikes the metal of the mask disposed between adjacent apertures 10*a* forms into droplets which fall under the influence of gravity away from the mask to the base of the etching apparatus. The tendency of radial flow of etchant across the mask blank is avoided and etching of the blank surface is drastically reduced. The etching for the most part results from the spray which projects through or penetrates the holes of the mask enlarging the holes as desired.

As indicated in FIG. 2*a*, there is in this process little if any tendency of a menicus to form at the small diameter section 10*a* of the individual apertures of the mask. Therefore, etchant which pentrates the holes from the inner side of mask 10 tends to flow back through the holes and contribute to the desired etching.

It is frequently desirable to grade the holes from the largest size at the center of the mask to a decreasing size with radial distance from the center. This is easily accomplished by arranging spray heads in the manner indicated by the dots in FIG. 3, arranging them in concentric circles spaced to achieve uniform coverage of the field of apertures. Grading control is easily exercised by changing the separation of the spray heads from the portion of the mask to which they are individually to direct etchant and it is also subject to control by varying the flow of etchant through the various spray heads. As a practical matter, it is convenient to feed the spray heads from a common manifold and exercise control by spacing the spray heads with respect to the plane of the mask.

Alternatively, a stick or a single line of spray heads 20 may be employed in the manner indicated in FIG. 2. Such an arrangement provides a ribbon pattern of etchant having a width that is small relative to the smallest dimension of the field of apertures and having a length which is at least equal to the largest dimension of that field. The linear array of spray heads, in this embodiment, is rotatably mounted and is continuously driven to rotate the pattern of etchant about an axis that is normal to the central area of mask 10. Rotation of the nozzle array causes the entire field of apertures to be sprayed as necessary to etch back or enlarge all of the apertures of the field. A suitable speed of rotation is 30 R.P.M.

The described process in which the shadow mask is supported in inverted position and sprayed from beneath has been demonstrated to provide superior uniformity in the re-etch process as compared with the prior practice described in connection with FIG. 1 and has further been demonstrated to effect minimal reduction of the mask blank which is a distinct advantage over the prior practice.

The process of the invention is uniquely attractive for re-etching the shadow mask but it is not confined to that application. Re-etching, of course, means that the mask will have been provided with a pattern of apertures prior to its introduction to the re-etch apparatus but the process is also useful in connection with a mask that has not previously been provided with apertures. In such a case, it is common practice to coat the mask blank with a resist which has discontinuities or holes at each place where an aperture is to be formed. If the surface of the mask facing the bank of spray heads in the arrangement of FIG. 2 is provided with such a resist coating, it may be sprayed in the manner described to provide a field of apertures of a desired size.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

What is claimed is:

1. In the manufacture of a color cathode ray tube having a color selection electrode comprising a mask which includes a convex surface provided wtih a field of apertures, each of which apertures has a large diameter portion and a smaller diameter portion, said electrode further having a frame portion extending from said mask portion to define a circumscribing flange, the process of re-etching said electrode, which process comprises the steps of:

supporting said electrode in an etching station with said frame portion vertically disposed and with said convex surface of said mask portion facing downward and with said large diameter portions of said apertures facing downward, spraying an etchant solely from beneath said electrode vertically upward against said convex surface into said large diameter portions of said apertures and out through said smaller diameter portions of said apertures in said convex surface of said mask portion to increase the size of said apertures a predetermined amount and maintaining said electrode with said convex surface facing downward while the etchant that penetrated said apertures is permitted to flow back down through said apertures to contribute further to enlargement of said apertures.

2. The process in accordance with claim 1 in which said etchant is sprayed vertically upward from a plurality of spray heads arranged in concentric circles to effect uniform coverage of the entire field of apertures in said mask portion so as to enlarge all of the apertures thereof at the same time and at a preselected relative rate.

3. The process in accordance with claim 1 in which the etchant is sprayed from a line of spray heads producing a ribbon pattern having a width that is small with respect to the field of apertures of said mask portion and having a length at least equal to that of said field of apertures;

and further in which said line of spray heads is rotated about an axis normal to the central portion of said field of apertures.

* * * * *